United States Patent [19]

Takara et al.

[11] Patent Number: 4,632,369

[45] Date of Patent: Dec. 30, 1986

[54] COIL-ANNEALING SPACER

[75] Inventors: Senju Takara, Kitakyushu; Yoshihiro Tanaka, Tokuyama, both of Japan

[73] Assignees: Toyo Kohan Co., Ltd, Tokyo; Tobata Iron Works Co., Ltd., Fukuoka, both of Japan

[21] Appl. No.: 742,180

[22] Filed: Jun. 7, 1985

[30] Foreign Application Priority Data

Jun. 11, 1984 [JP] Japan ..... 59-120438

[51] Int. Cl.[4] ..... C21D 9/673

[52] U.S. Cl. ..... 266/262; 266/287; 432/260

[58] Field of Search ..... 266/262, 263, 256; 432/260, 205, 254.1

[56] References Cited

U.S. PATENT DOCUMENTS

| | | | |
|---|---|---|---|
| 4,287,940 | 9/1981 | Corbett, Jr. | 165/48 R |
| 4,310,302 | 1/1982 | Thekdi | 432/205 |
| 4,423,857 | 1/1984 | Muzak | 266/262 |
| 4,445,852 | 5/1984 | Corbett | 432/260 |

FOREIGN PATENT DOCUMENTS

| | | | |
|---|---|---|---|
| 49-11296 | 3/1974 | Japan . | |
| 1972 | 1/1980 | Japan | 266/256 |
| 55-24130 | 6/1980 | Japan . | |
| 56-166337 | 12/1981 | Japan . | |

*Primary Examiner*—Christopher W. Brody
*Attorney, Agent, or Firm*—Armstrong, Nikaido, Marmelstein & Kubovcik

[57] ABSTRACT

Disclosed is a coil-annealing spacer which comprises a pair of upper and lower discs, each having a round hole in the central portion thereof, and longitudinal ribs disposed between the discs and secured thereto and extended radially or spirally radially from the round hole of each disc toward the periphery, wherein heat transfer fins are arranged on the inner wall of a gas passage defined by said upper and lower discs and said longitudinal rib along the flow of an atmosphere gas.

If this coil-annealing spacer is used, the heating/cooling time is shortened at the annealing step to enhance the manufacturing capacity, and the deviation of the quality in the product coil is reduced.

4 Claims, 4 Drawing Figures

COIL-ANNEALING SPACER

BACKGROUND OF THE INVENTION (1) Field of the Invention

The present invention relates to a coil-annealing spacer for use in box annealing of a coil-rolled metal strip for mainly removing a working strain.

(2) Description of the Prior Art

For box annealing of a metal strip coil, there is ordinarily adopted a method in which a coil is placed on a base having a base fan arranged on a central opening thereof, another coil is placed on this coil through a coil-annealing spacer (i.e. diffuser or convector), two to about six coils as a whole are piled in the stacked state, the assembled coils are covered with an inner cover and an outer cover, the inner cover is heated from the outside for a predetermined time, the outer cover is removed to naturally cool the inner cover, the inner cover is then forcibly air-cooled from the outside, the inner cover is also removed after the coil temperature is sufficiently lowered, and the coils are taken out. Incidentally, the atmosphere within the inner cover is air-purged in advance before annealing and substituted by a reducing or non-oxidizing gas, and during annealing, the pressure within the inner cover is maintained at a level slightly higher than the atmospheric air pressure and the atmosphere gas within the inner cover is forcibly circulated by the base fan.

In this annealing process, propagation of heat, either heating or cooling, is effected by radiation and convection, and the coil-annealing spacer exerts a function of promoting propagation of heat particularly by convention (contact of the atmosphere gas with the metal).

Various coil-annealing spacers differing in the shape have been designed and practically used for improving such heat transfer function, removing the heat strain and facilitating the manufacture of the spacer. For example, there can be mentioned a coil-annealing spacer in which some volute notches intersecting the involute type ribs are formed on each of upper and lower discs so as to enhance the contact efficiency between the side face of a coil (end edge of the strip) and the atmosphere gas (see Japanese Utility Model Publication No. 55-24130), a coil-annealing spacer in which plural guide ribs forming volute passages are inserted between two plates, the periphery of one plate is expanded over the peripheral edge of the other plate and said one plate is provided with a curved annular portion bent toward the other plate to change the flowing direction of the atmosphere gas (see Japanese Patent Application Laid-Open No. 56-166337), and a coil-annealing spacer in which metal spirals as a helical spring are connected to the entire face of at least one surface of a base plate and projecting walls are appropriately formed on the base plate to promote disturbance of a flow of the atmosphere gas (see Japanese Utility Model Publication No. 49-11296).

In each of these conventional coil-annealing spacers, however, the central portion of the coil between the inner and outer diameters of the coil, that is, the central portion of the coil in the radial direction, is most difficulty heated, and the temperature of this central portion is lowest at the heating step, i.e. the central portion tends to be the lowest-temperature point. While on the other hand, since the central portion is most difficulty cooled at the cooling step, the central portion tends to be the highest-temperature point. Accordingly, the annealing time cannot be shortened enough and homogenization of the produced strip quality is limited.

This tendency is a fatal defect of box annealing, and the problem has not been solved by the conventional techniques.

Incidentally, by the term "box annealing" is meant an idea of box annealing inclusive of continuous or semi-continuous coil annealing.

SUMMARY OF THE INVENTION

Under this background, we made research with a view to developing a coil-annealing spacer capable of box-annealing a metal strip coil at a high heat efficiency, and as the result, it was found that when heat transfer fins are arranged in a gas passage defined by upper and lower discs and a longitudinal rib, the heating/cooling time at the annealing step can be shortened and the above-mentioned problem involved in the conventional techniques can be solved. We have now completed the present invention based on this finding.

It is therefore a primary object of the present invention to provide a coil-annealing spacer in which the heat transfer efficiency by convection of an atmosphere gas is enhanced, the heating/cooling time at the annealing step is shortened and the manufacturing capacity is increased.

Another object of the present invention is to provide a coil-annealing spacer in which the temperature gradient in coils is reduced at the heating and cooling steps to provide products having a reduced deviation of the quality.

More specifically, in accordance with the present invention, there is provided a coil-annealing spacer which comprises a pair of upper and lower discs, each having a round hole in the central portion thereof, and longitudinal ribs disposed between the discs and secured thereto and extended radially or spirally radially from the round hole of each disc toward the periphery, wherein heat transfer fins are arranged on the inner wall of gas passages defined by said upper and lower discs and said longitudinal ribs along the flow of an atmosphere gas.

If the coil-annealing spacer of the present invention having the above-mentioned structure is adopted, the efficiency of heat transfer by convention of the atmosphere gas is enhanced and the heating/cooling time at the annealing step is shortened, whereby the manufacturing capacity is increased.

These heat transfer fins may be arranged in the substantially central portion in the radial direction of the upper and lower discs of the coil-annealing spacer.

Incidentally, the upper and lower discs of the coil-annealing spacer of the present invention may have not only a circular shape but also a polygonal shape.

DETAILED DESCRIPTION OF THE PREFERRED EMBODIMENTS

The present invention will now be described in detail with reference to one embodiment illustrated in the accompanying drawings.

Figure 1:
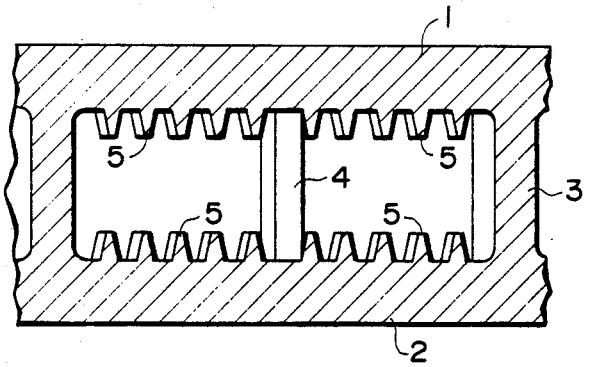
FIG. 1 is a longitudinally sectional view of a gas passage in one embodiment of the present invention.
Figure 2:
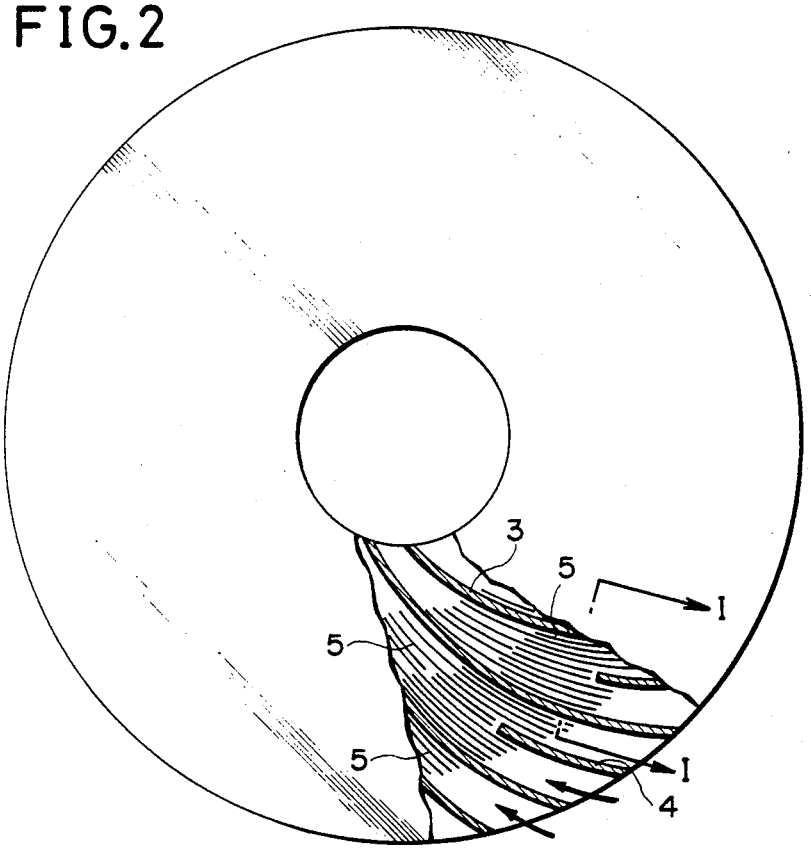
FIG. 2 is partially perspective top plan view of the embodiment of the present invention.

FIG. 1 is a longitudinally sectional view of an atmosphere gas passage in one embodiment of the present invention, which corresponds to a view showing the section taken along the line I—I in FIG. 2, and FIG. 2 is a partially perspective top plan view of the embodiment of the present invention.

Referring to FIG. 1, in the present embodiment, upper and lower discs 1 and 2, longitudinal ribs 3, reinforcing longitudinal ribs 4 and heat transfer fins 5 are integrally formed of ductile cast iron. Needless to say, the heat transfer fins 5 need not be formed by integral casting but it may be separately prepared and secured to the inner walls of the upper and lower discs 1 and 2 and the longitudinal ribs 3 by fitting, welding or the like means.

Figure 3:
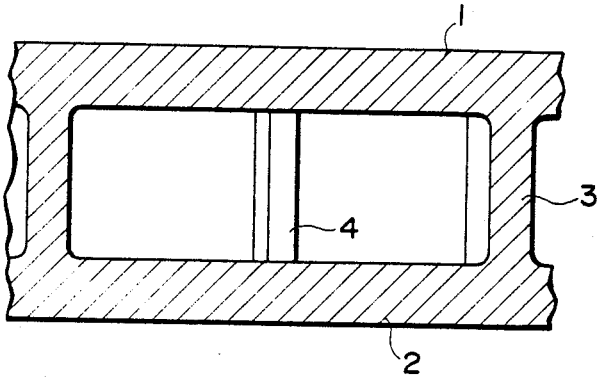
FIG. 3 is a longitudinally sectional view of a gas passage in a conventional coil-annealing spacer.

FIG. 3 is a longitudinally sectional view of an atmosphere gas passage in a conventional coil-annealing spacer. The embodiment of the present invention is different from this conventional spacer in the point that plural heat transfer fins 5 are formed on the upper and lower discs 1 and 2. Of course, the heat transfer fins 5 may be formed only on one of the upper and lower surfaces of the upper and lower discs 1 and 2.

The heat transfer fins 5 are formed along the flow of the atmosphere gas, for example, in the shape of a laminar airfoil, so that the flow of the atmosphere gas in the direction of an arrow in FIG. 2, that is, the flow directed from the back side of the paper surface to the front side in FIG. 1, is not disturbed at all. If the heat transfer fins 5 are disposed against the flow of the atmosphere gas, the resistance of the gas passage is increased and the pressure loss is increased. Accordingly, such arrangement should be avoided.

The heat transfer fins 5 may also be formed on the wall faces of the longitudinal ribs 3 and the reinforcing longitudinal ribs 4. However, the heat transfer fins 5 formed on the upper and lower discs 1 and 2 are more effective, because the distances between these heat transfer fins 5 and the side face of the coil (the upper and lower faces of the upper end coils) which should be heated or cooled, are smaller than those distances of the heat transfer fins 5 formed on the ribs 3 or 4. The shape and size of each heat transfer fin 5 may be changed according to the inner and outer diameters and height of the coil-annealing spacer and the shape and size of the spacer. It is preferred that by disposing the heat transfer fins 5, the total surface area of the inner wall of the gas passing opening (gas passage) be increased to 1.1 to 4.5 times, especially 1.2 to 3.5 times, comparing with the total surface area in the conventional type provided with no heat transfer fins.

If the surface area increase ratio is lower than 1.5, no substantial effect is attained, and if the surface area increase ratio exceeds 4.5, the pressure loss because of reduction of the sectional area of the atmosphere gas passage becomes prominent and the heat transfer efficiency is lowered unless the power of the base fan is particularly increased.

From the results of experiments made by us, it has been confirmed that a most preferred surface area inclease ratio is in the range of from 1.5 to 2.5.

A conventional coil-annealing spacer is illustrated in FIG. 3 for the sake of comparison. If FIG. 3 is compared with FIG. 1, it will readily be understood that in the embodiment of the present invention shown in FIG. 1, even if the heat transfer surface area is increased, the pressure loss is hardly caused.

The arrangement of the heat transfer fins 5 will now be described. In the present embodiment, as shown in FIG. 2, the heat transfer fins 5 are arranged substantially in the central portion in the radial direction of the spacer so that the above-mentioned lowest-temperature point and highest-temperature point of the coil are rapidly heated and cooled, whereby the temperature gradient in the coil is reduced. In the present invention, however, there may be adopted a modification in which heat transfer fins 5 are arranged throughout the atmosphere gas passage and the size and shape of the heat transfer fins 5 are changed so that the surface area is increased only in the substantially central portion in the radial direction of the spacer.

Figure 4:
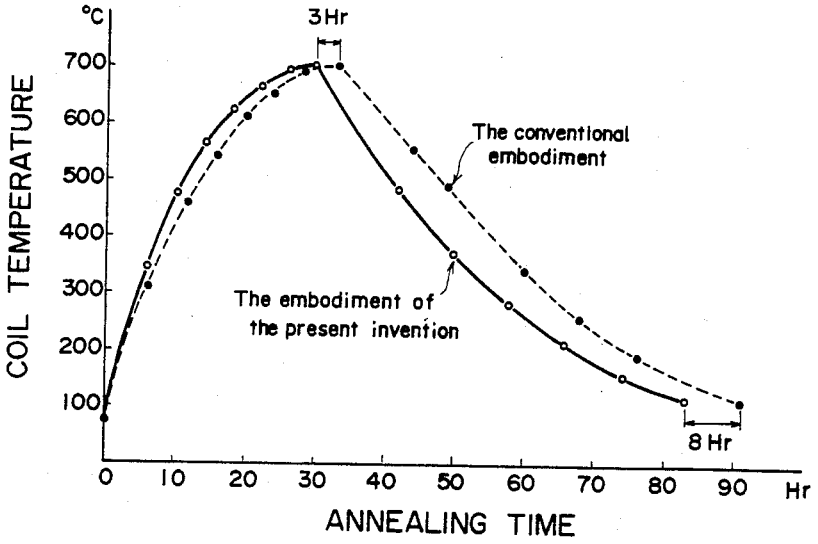
FIG. 4 is a graph illustrating the effect of the embodiment of the present invention.

FIG. 4 is a graph showing the temperatures within the coil (lowest-temperature and highest-temperature points) during the annealing operation, which illustrates the effect attained in the present embodiment of the present invention.

In FIG. 4, the temperature in the coil is plotted on the ordinate and the time after ignition of a burner of the outer cover is plotted on the abscissa. In FIG. 4, the solid line indicates the results obtained in the embodiment of the present invention. From FIG. 4, it is seen that as compared with the results obtained in the conventional spacer (indicated by a dot line), in the embodiment of the present invention, the heating time required for elevation of the temperature to the soaking temperature and the cooling time required for lowering of the temperature to the box-opening temperature from the soaking temperature are shortened by about 3 hours and about 5 hours, respectively, and the total annealing time is shortened by about 8 hours. Furthermore, it has been confirmed that the deviation of the mechanical properties and metallurgical properties among product coils is much smaller than in case of the conventional technique.

According to the present invention, since the heat transfer fins are arranged along a flow of an atmosphere gas on the inner wall of a gas passage defined by upper and lower discs of a coil-annealing spacer and a longitudinal rib, the surface area within the gas passage is increased and the temperature of the atmosphere gas passing through this passage is transferred to the entire surface area or vice versa. Accordingly, the temperature of the spacer is elevated or lowered to a desired level more rapidly than in the conventional technique, and heating and cooling can be accomplished within a shorter time. Moreover, since these heat transfer fins 5 are arranged along the flow of the atmosphere gas, the flow of the atmosphere gas passing through the central portions of the upper and lower discs is not disturbed and the atmosphere gas flows very smoothly. Therefore, heat transfer by the atmosphere gas flowing convectively through the central portions of the upper and lower discs and heat transfer by the spacer including the heat transfer fins are simultaneously effected and the efficiency of the heat transfer to the metal strip coil is enhanced, with the result that the heating/cooling time at the annealing step can be shortened and the fuel and atmosphere gas can be saved.

In the case where the heat transfer fins are arranged in the substantially central portion in the radial direction of the upper and lower discs of the coil-annealing spacer, since the inner surface area of the gas passage is increased in the vicinity of the lowest-temperature point or the highest-temperature point of the coil, this point can be rapidly heated or cooled and the temperature gradient in the coil can be reduced during heating or cooling, with the result that the deviation of the quality in the product coil can be reduced.

Furthermore, according to the present invention, since the heating/cooling time can be shortened at the annealing step, and the working efficiency of the base is increased and the manufacturing capacity of an annealing plant is increased.

What is claimed is:

1. A coil-annealing spacer which comprises a pair of upper and lower discs, each having a round hole in the central portion thereof, and longitudinal ribs disposed between the discs and secured thereto and extended radially or spirally radially from the round hole of each disc toward the periphery, wherein heat transfer fins are arranged on at least one inner wall of a gas passage defined by said upper and lower discs and said longitudinal ribs along the flow of an atmosphere gas.

2. A coil-annealing spacer as set forth in claim 1, wherein the heat transfer fins are arranged on a part of at least one surface of said gas passages which is defined by one of the discs.

3. A coil-annealing spacer as set forth in claim 1 or 2, wherein the heat transfer fins are arranged substantially in the central portion in the radial direction of the upper and lower discs.

4. A coil-annealing spacer as set forth in claim 1, wherein the heat transfer fins are arranged throughout the gas passages and have a larger surface area substantially in the central portion in the radial direction of the upper and lower discs.

* * * * *